US008162453B2

(12) United States Patent
Kojima

(10) Patent No.: US 8,162,453 B2
(45) Date of Patent: Apr. 24, 2012

(54) INKJET RECORDING APPARATUS AND INK SUPPLY METHOD

(75) Inventor: Toshiya Kojima, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 825 days.

(21) Appl. No.: 12/030,373

(22) Filed: Feb. 13, 2008

(65) Prior Publication Data

US 2008/0192095 A1 Aug. 14, 2008

(30) Foreign Application Priority Data

Feb. 14, 2007 (JP) ..... 2007-033776

(51) Int. Cl.
*B41J 2/175* (2006.01)

(52) U.S. Cl. ..... 347/85; 347/6

(58) Field of Classification Search ..... 347/6, 7, 347/10, 84, 85, 88, 89, 93; 417/199.1, 199.2, 417/435, 437, 521, 522, 537; 141/18, 21, 141/25; 401/151, 222, 230
See application file for complete search history.

(56) References Cited

U.S. PATENT DOCUMENTS 5,500,663 A 3/1996 Ujita et al.
5,912,688 A * 6/1999 Gragg ..... 347/86
(Continued)

FOREIGN PATENT DOCUMENTS

JP 59052662 A * 3/1984
(Continued)

OTHER PUBLICATIONS

Japanese Office Action issued on Jan. 10, 2012, in Japanese Patent Application No. 2008-031839 (English translation attached).

*Primary Examiner* — Charlie Peng
*Assistant Examiner* — Peter Radkowski
(74) *Attorney, Agent, or Firm* — Birch, Stewart, Kolasch & Birch, LLP

(57) ABSTRACT

The inkjet recording apparatus includes: print heads each of which has ejection ports through which ink is ejected; main tanks each of which stores the ink; ink supply channels which respectively connect the main tanks with the print heads; subsidiary tanks which are arranged in the ink supply channels and each of which includes an external case and an ink accommodating member that is flexible and arranged in the external case, the ink being supplied from the main tanks to the print heads through the ink supply channels and the ink accommodating members in the subsidiary tanks; a pressure buffer which is connected to spaces in the subsidiary tanks between the external cases and the ink accommodating members; a pressure reducing pump which reduces a pressure Pb inside the pressure buffer; differential pressure valves which are respectively attached to the subsidiary tanks so as to connect the spaces in the subsidiary tanks with an atmosphere; a first pressure gage which measures the pressure Pb inside the pressure buffer; and a second pressure gage which measures pressures Ps inside the spaces in the subsidiary tanks, wherein an operation of the pressure reducing pump to reduce the pressure Pb inside the pressure buffer is performed and the differential pressure valves adjust the pressures Ps inside the spaces in the subsidiary tanks so that the pressure Pb inside the pressure buffer and each of the pressures Ps inside the spaces in the subsidiary tanks have a relationship of Pb<Ps, at least while the ink is being ejected from the print heads.

6 Claims, 11 Drawing Sheets

U.S. PATENT DOCUMENTS

| | | | | |
|---|---|---|---|---|
| 6,164,766 | A * | 12/2000 | Erickson | 347/85 |
| 6,315,402 | B1 | 11/2001 | Kawase | |
| 6,520,630 | B1 * | 2/2003 | Oda et al. | 347/85 |
| 6,585,358 | B2 * | 7/2003 | Usui et al. | 347/85 |
| 6,773,097 | B2 * | 8/2004 | Dowell | 347/85 |
| 2002/0109760 | A1 * | 8/2002 | Miyazawa et al. | 347/86 |
| 2003/0043240 | A1 * | 3/2003 | Dowell | 347/85 |
| 2003/0128251 | A1 * | 7/2003 | Ujita | 347/29 |
| 2003/0128261 | A1 * | 7/2003 | Usui et al. | 347/86 |
| 2003/0202057 | A1 * | 10/2003 | Childs et al. | 347/85 |
| 2005/0062815 | A1 * | 3/2005 | Yoshihira et al. | 347/89 |
| 2005/0212874 | A1 * | 9/2005 | Nomura et al. | 347/84 |
| 2006/0114298 | A1 * | 6/2006 | Anderson et al. | 347/85 |
| 2006/0132555 | A1 * | 6/2006 | Uehara et al. | 347/85 |
| 2006/0284946 | A1 * | 12/2006 | Miyazawa | 347/85 |
| 2007/0229629 | A1 * | 10/2007 | Miyazawa et al. | 347/86 |
| 2008/0043075 | A1 * | 2/2008 | Langford et al. | 347/87 |

FOREIGN PATENT DOCUMENTS

| | | | |
|---|---|---|---|
| JP | 5-229137 | A | 9/1993 |
| JP | 200-141687 | A | 5/2000 |
| JP | 2003-182104 | A | 7/2003 |
| JP | 2005-41048 | A | 2/2005 |

* cited by examiner

INKJET RECORDING APPARATUS AND INK SUPPLY METHOD

BACKGROUND OF THE INVENTION

1. Field of the Invention

The present invention relates to an inkjet recording apparatus and an ink supply method, and more particularly to technology for controlling the back pressure of ink supplied to an inkjet head.

2. Description of the Related Art

An inkjet recording apparatus (inkjet printer) as an image forming apparatus has been known which includes an inkjet head (print head) having a plurality of nozzles (ink ejection ports) and which forms an image on a recording medium by ejecting ink in the form of liquid droplets from the nozzles while causing the inkjet head and the recording medium to move relatively with respect to each other.

In this inkjet recording apparatus, the ink is typically supplied from an ink tank which stores ink, to the inkjet head, via an ink supply channel. During printing, the nozzles of the inkjet head are required to be filled with ink at all times, in order to be able to carry out printing immediately whenever there is a print instruction, but on the other hand, it is also necessary to keep the ink pressure inside the nozzles at a negative pressure, in order to prevent the ink from leaking out from the nozzles.

Therefore, various methods have been proposed for controlling the back pressure in the inkjet head in such a manner that the nozzle sections in the head assume a negative pressure.

For example, Japanese Patent Application Publication No. 2005-041048 discloses a liquid ejection apparatus which includes: a recording head; an ink cartridge which supplies ink to the recording head; and a pressure control unit connected to the ink cartridge via a pressure control tube. The ink cartridge in this liquid ejection apparatus is constituted of an ink case which accommodates one or more ink packs serving as liquid accommodating bags. The pressure control unit in this liquid ejection apparatus is constituted of: a pressure sensor which determines the air pressure inside the pressure control tube; an atmosphere release valve which connects the interior of the pressure control tube to the atmosphere; a pump which controls the air pressure inside the ink cartridge; and a pressure control valve which can open or close the connection between the pressure control tube and the pump. In this liquid ejection apparatus, the negative pressure of the ink in the recording head is controlled by adjusting the air pressure inside the ink cartridge by means of the pump and the pressure control valve so as to keep the air pressure inside the ink cartridge in a prescribed range.

Moreover, Japanese Patent Application Publication No. 2000-141687 discloses an inkjet recording apparatus which includes: a recording head; an ink tank having an ink bag arranged in an external case; a subsidiary tank which has an ink bag and is arranged between the recording head and the ink tank; a pump which applies pressure to each of the ink bags by incorporating air into a space between the external case and the ink bag that is hermetically sealed inside the external case; and a switching valve which switches the connection between the pump, the ink tank and the subsidiary tank (external cases of the ink tank and the subsidiary tank). In this inkjet recording apparatus, the ink is supplied to the subsidiary tank or the ink containing bubbles (gas bubbles) is expelled from the recording head by switching the switching valve so that the ink is supplied to the recording head.

FIG. 11A is a diagram showing the liquid ejection apparatus described in Japanese Patent Application Publication No. 2005-041048 in a case where the liquid ejection apparatus is provided with a plurality of the recording heads 904. As shown in FIG. 11A a cartridge 906 serving as a subsidiary tank is disposed between the main tanks 902 and the recording heads 904, and the cartridge 906 includes a plurality of ink packs 908 that are respectively provided for the main tanks 902 (recording heads 904). The internal pressure Po of the cartridge 906 is adjusted by means of the pump 910 shown in FIG. 11A. However, in this liquid ejection apparatus, it is difficult to control the back pressure independently for each of the recording heads 904, since the levels H1 and H2 of the ink in the ink packs 908 change depending on the remaining amounts of the ink in the ink packs 908 as shown in FIG. 11B.

In this case, in order to control the back pressure in each of the recording heads 904, as shown in FIG. 11C, it is necessary to provide cartridges 906-1 and 906-2 which respectively accommodate ink packs 908-1 and 908-2, separately for each head 904-1 and 904-2. By means of the configuration shown in FIG. 11C, it is possible to control the respective internal pressures $P_1$ and $P_2$, independently, in such a manner that the internal pressure $P_1$ of the ink pack 908-1 having the lower level of the ink is greater than the internal pressure $P_2$ of the ink pack 908-2 having the higher level of the ink, namely a condition of $P_1>P_2$ is satisfied ($P_1$ and $P_2$ are negative pressures; and $P_2$ is less than $P_1$). However, if a cartridge is provided for each of the recording heads as shown in FIG. 11C then the size of the liquid ejection apparatus becomes larger.

Moreover, particularly in a case where the liquid ejection apparatus is an inkjet recording apparatus of large ink consumption that includes a full line head which covers the full width of the recording medium and performs recording by means of a single scan, the ink packs are large in size and therefore, in order to make the apparatus as compact as possible, the apparatus is required to extend in a vertical direction (i.e., a direction perpendicular to the recording medium). In this case, the effect of the variation in the pressure head due to the ink consumption on the negative pressure applied to the recording head cannot be ignored, and it is difficult to achieve a uniform back pressure in the plurality of recording heads.

FIG. 12A is a diagram showing a configuration of the liquid ejection apparatus for a single color that includes a main tank 902, a head 904, a cartridge 906, an ink pack 908 and a pump 910. FIG. 12B is a diagram showing a configuration whereby the uniform back pressure is achieved in the plurality of recording heads by providing the configuration (for a single color) shown in FIG. 12A for each of the recording heads 904-1 to 904-3. However, if this configuration is adopted, there is a problem in that the liquid ejection apparatus increases in size and costs also rise.

Furthermore, in order to suppress increase in costs, it would be possible to use a common pump and to provide switching valves which switch the connection between the pump, the ink tanks and the subsidiary tanks (the external cases of the ink tanks and the subsidiary tanks), as in the apparatus described in Japanese Patent Application Publication No. 2000-141687. However, in the case of a switching valve as described in Japanese Patent Application Publication No. 2000-141687, there is a problem in that inks can only be supplied to the recording heads by switching sequentially through the colors, one at a time, and it is difficult to achieve a simultaneous operation for the plurality of colors.

Moreover, since the refilling of ink into the subsidiary tank and the discharge of ink from the subsidiary tank cannot be carried out simultaneously, then in a case where, for example, the consumption of ink of one color is extremely high, the ink supply cannot respond adequately to demand. Further, in order to avoid this problem, it becomes necessary to provide large subsidiary tanks, and therefore the apparatus increases in size and costs are liable to rise.

SUMMARY OF THE INVENTION

The present invention has been contrived in view of the foregoing circumstances, an object thereof being to provide an inkjet recording apparatus and an ink supply method whereby the back pressures of all recording heads can be controlled independently, by means of a common pump, while also making the apparatus more compact in size and reducing costs.

In order to attain the aforementioned object, the present invention is directed to an inkjet recording apparatus comprising: print heads each of which has ejection ports through which ink is ejected; main tanks each of which stores the ink; ink supply channels which respectively connect the main tanks with the print heads; subsidiary tanks which are arranged in the ink supply channels and each of which includes an external case and an ink accommodating member that is flexible and arranged in the external case, the ink being supplied from the main tanks to the print heads through the ink supply channels and the ink accommodating members in the subsidiary tanks; a pressure buffer which is connected to spaces in the subsidiary tanks between the external cases and the ink accommodating members; a pressure reducing pump which reduces a pressure Pb inside the pressure buffer; differential pressure valves which are respectively attached to the subsidiary tanks so as to connect the spaces in the subsidiary tanks with an atmosphere; a first pressure gage which measures the pressure Pb inside the pressure buffer; and a second pressure gage which measures pressures Ps inside the spaces in the subsidiary tanks, wherein an operation of the pressure reducing pump to reduce the pressure Pb inside the pressure buffer is performed and the differential pressure valves adjust the pressures Ps inside the spaces in the subsidiary tanks so that the pressure Pb inside the pressure buffer and each of the pressures Ps inside the spaces in the subsidiary tanks have a relationship of $Pb<Ps$, at least while the ink is being ejected from the print heads.

In this aspect of the present invention, it is possible to control the back pressures of the plurality of print heads, independently, by using the same (common) pump for the plurality of print heads, and therefore the apparatus can be made compact in size, the number of constituent members is reduced, and costs can be reduced.

Preferably, the operation of the pressure reducing pump is halted, while the ink is not being ejected from the print heads.

In this aspect of the present invention, it is not necessary to operate the pump at all times, and the load on the pump can be reduced.

Preferably, the operation of the pressure reducing pump is resumed before the ink is started to be ejected from the print heads, when printing is restarted from a state where the ink is not being ejected from the print heads and the operation of the pressure reducing pump is halted.

In this aspect of the present invention, it is possible to maintain a uniform back pressure for the print heads and to achieve stable ejection of ink, in the case of a restart of printing which involves sudden consumption of ink. The volume of the ejected liquid droplets is therefore kept uniform and high-quality printing is possible.

Preferably, the above-described inkjet recording apparatus further comprises a valve arranged between the pressure buffer and the pressure reducing pump, wherein the valve is closed and the operation of the pressure reducing pump is halted, while the ink is not being ejected from the print heads.

In this aspect of the present invention, if there is no consumption of ink, then it is possible to halt the operation of the pump, and hence the load on the pump can be reduced. Consequently, the durability of the pump is improved and power consumption is reduced. Furthermore, noise and vibration can also be prevented.

Preferably, the above-described inkjet recording apparatus further comprises valves which are arranged between the pressure buffer and the subsidiary tanks, respectively, wherein the valves are closed and the operation of the pressure reducing pump is halted, while the ink is not being ejected from the print heads.

In this aspect of the present invention, if none of the print heads is performing ink ejection and there is no consumption of ink, then by closing all of the valves, it is possible to halt the operation of the pump, and the load on the pump can be reduced. Therefore, the durability of the pump is improved and power consumption is reduced. Furthermore, noise and vibration can also be prevented.

In order to attain the aforementioned object, the present invention is also directed to a method of supplying ink from main tanks to print heads for an inkjet recording apparatus which includes: the print heads each of which has ejection ports through which the ink is ejected; the main tanks each of which stores the ink; subsidiary tanks which are respectively arranged between the main tanks and the print heads and each of which includes an external case and an ink accommodating member that is flexible and arranged in the external case, the ink being supplied from the main tanks to the print heads through the ink accommodating members in the subsidiary tanks; a pressure buffer which is connected to spaces in the subsidiary tanks between the external cases and the ink accommodating members; a pressure reducing pump which reduces a pressure inside the pressure buffer; and differential pressure valves which are respectively attached to the subsidiary tanks and connect the spaces in the subsidiary tanks with an atmosphere, the method comprising the steps of: measuring pressures Ps inside the spaces in the subsidiary tanks between the external cases and the ink accommodating members; measuring a pressure Pb inside the pressure chamber; and reducing the pressure Pb inside the pressure buffer by means of the pressure reducing pump and adjusting the pressures Ps by means of the differential pressure valves so that the pressure Pb and each of the pressures Ps have a relationship of $Pb<Ps$, at least while the ink is being ejected from the print heads.

In this aspect of the present invention, it is possible to control the back pressures of a plurality of print heads, independently, by using the same pump for the plurality of print heads, and therefore the apparatus can be made compact in size and costs can be reduced.

As described above, according to the present invention, it is possible to control the back pressures of a plurality of print heads, independently, by using the same pump for the plurality of print heads, and therefore the apparatus can be made compact in size and costs can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 6A and 6B are cross-sectional diagrams showing the structure of a differential pressure valve, wherein FIG. 6A shows a state where the differential pressure valve is closed and FIG. 6B shows a state where the differential pressure valve is open;

DETAILED DESCRIPTION OF THE PREFERRED EMBODIMENTS

Figure 1:
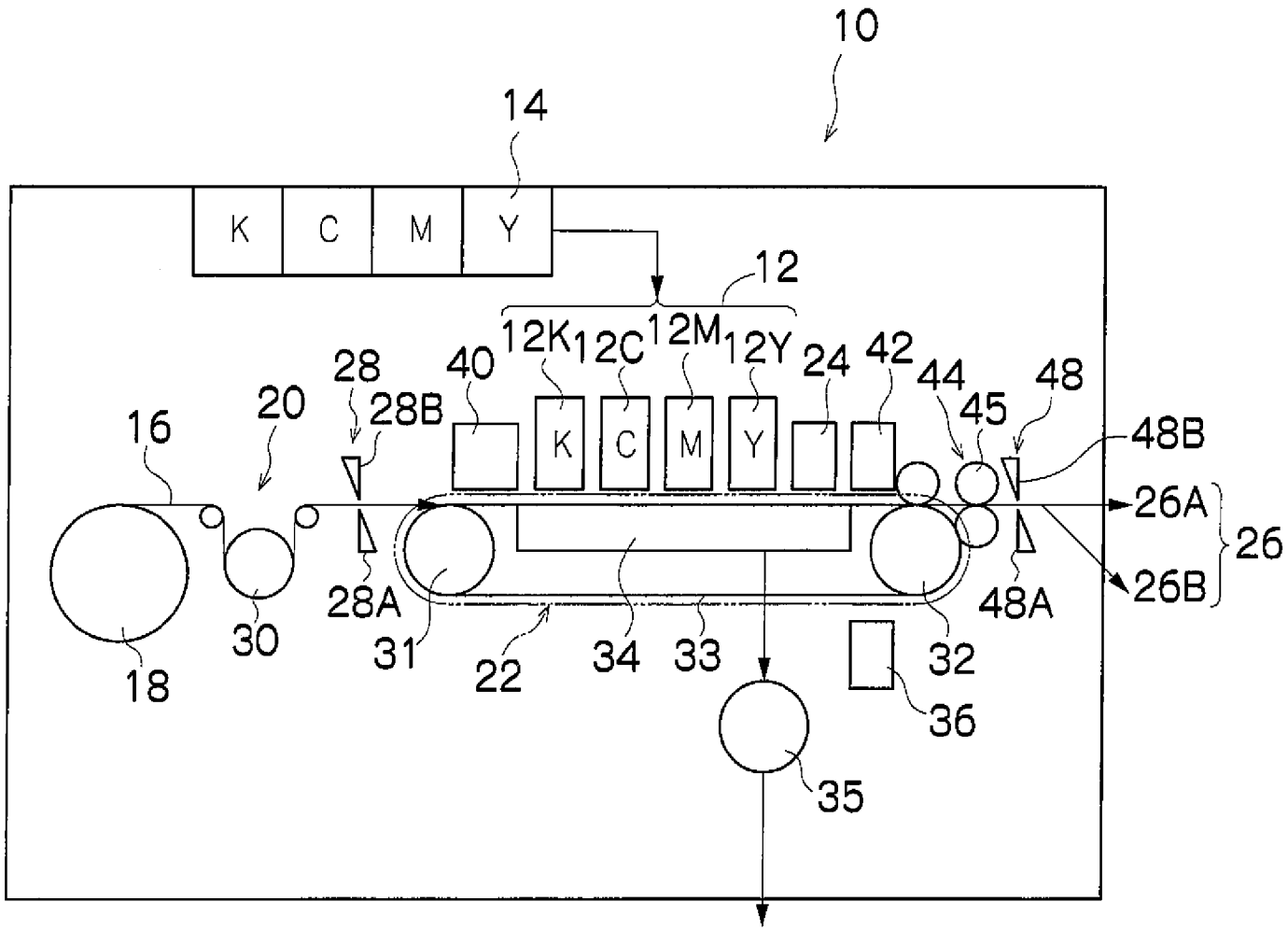
FIG. 1 is a general schematic drawing showing a general view of an inkjet recording apparatus according to a first embodiment of the present invention.

FIG. 1 is a general schematic drawing showing a general view of an inkjet recording apparatus according to an embodiment of the present invention.

As shown in FIG. 1, the inkjet recording apparatus 10 comprises: a print unit 12 having a plurality of print heads (liquid ejection head) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt conveyance unit 22 may use a vacuum suction conveyance method in which the recording paper 16 is conveyed by being suctioned onto the belt 33 by negative pressure created by suctioning air through suction holes provided on the belt surface, but there are no particular restrictions on the method of the belt conveyance unit 22 and it may also use a method based on electrostatic attraction.

The belt 33 has a width that is greater than the width of the recording paper 16, and a plurality of suction holes are formed on the belt surface (not illustrated) when the above-mentioned vacuum suction conveyance method is used. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not illustrated) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air 15 blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2:
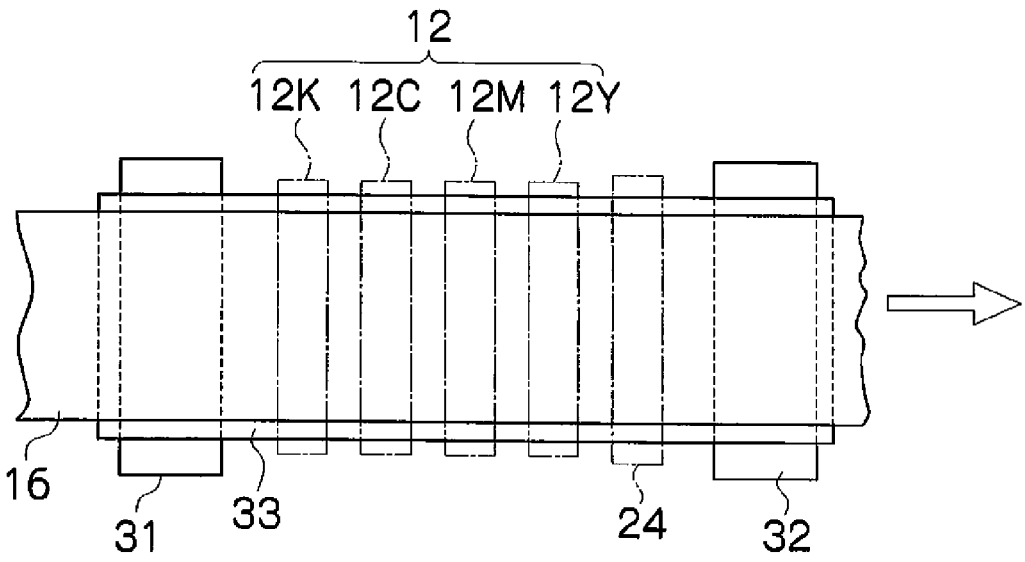
FIG. 2 is a principal plan view of the print unit of the inkjet recording apparatus shown in FIG. 1.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction), as shown by an arrow in this Figure.

Each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color image can be formed on the recording paper 16 by ejecting inks of different colors from the print heads 12K, 12C, 12M and 12Y, respectively, onto the recording paper 16 while the recording paper 16.

By adopting a configuration in which the full line heads are provided for the respective colors in this way to cover the full paper width, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. Higher-speed printing is thereby made possible and productivity can be improved in comparison with a shuttle type head configuration in which a print head reciprocates in the main scanning direction.

Here, the terms main scanning direction and sub-scanning direction are used in the following senses. More specifically, in a full-line head comprising rows of nozzles that have a length corresponding to the entire width of the recording paper, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although the configuration with the KCMY four standard colors is described in the present embodiment, combinations of the ink colors and the number of colors are not limited to those. Light inks and dark inks can be added as required. For example, a configuration is possible in which print heads for ejecting light-colored inks such as light cyan and light magenta are added.

As shown in FIG. 1, the ink storing and loading unit 14 has tanks (main tanks, which will be described later) for storing the inks of K, C, M and Y to be supplied to the print heads 12K, 12C, 12M, and 12Y, and the tanks are connected to the print heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row composed of photoelectric transducing elements (pixels) arranged in a line provided with an R filter, a green (C) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Figure 3:
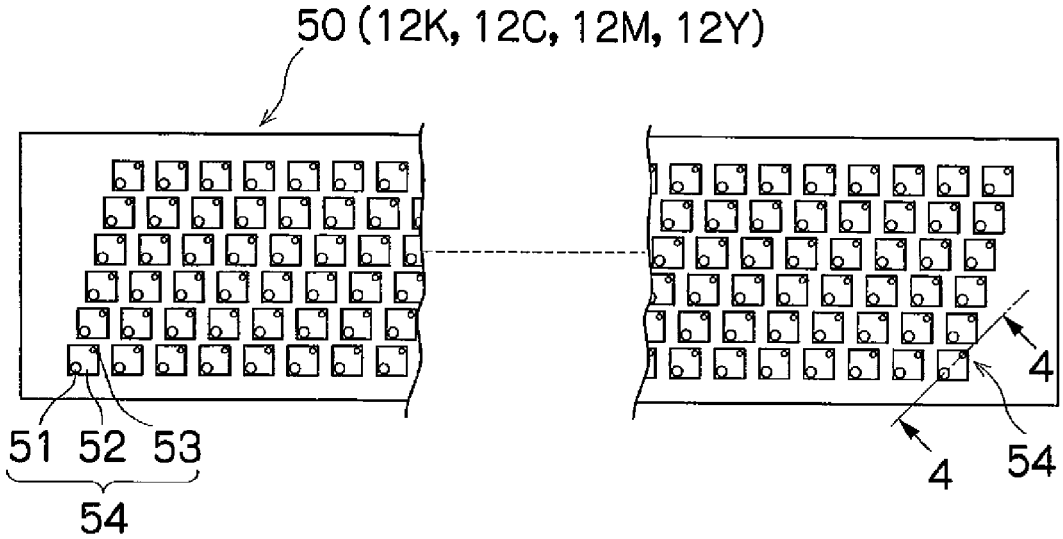
FIG. 3 is a plan view perspective diagram of a print head.

Next, the arrangement of nozzles (liquid ejection ports) in the print head (liquid ejection head) will be described. The print heads 12K, 12C, 12M and 12Y provided for the respective ink colors each have the same structure, and a print head forming a representative example of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle 51 for ejecting ink in the form of ink droplets, a pressure chamber 52 for applying pressure to the ink in order to eject ink, and an ink supply port 53 for supplying ink to the pressure chamber 52 from a common flow channel (not shown in FIG. 3).

In the example shown in FIG. 3, the pressure chambers 52 each have an approximately square planar shape when viewed from above, but the planar shape of the pressure chambers 52 is not limited to a square shape, and it may also be an approximate rhomboid shape, or the like. As shown in FIG. 3, a nozzle 51 is formed at one end of a diagonal of each pressure chamber 52, as viewed from above, and an ink supply port 53 is provided at the other end thereof.

Figure 4:
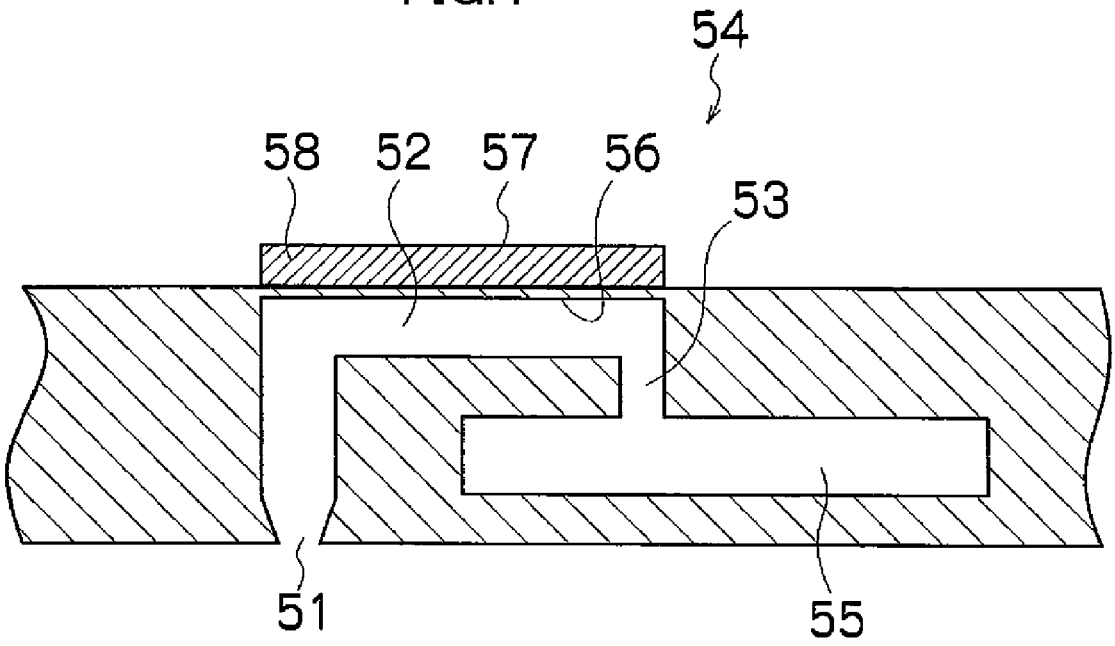
FIG. 4 is a cross-sectional diagram along line 4-4 in FIG. 3.

Furthermore, FIG. 4 shows a cross-sectional diagram along line 4-4 in FIG. 3.

As shown in FIG. 4, each pressure chamber unit 54 is formed by a pressure chamber 52 which is connected to a nozzle 51 that ejects ink, a common flow channel 55 for supplying ink via a supply port 53 is connected to the pressure chamber 52, and one surface of the pressure chamber 52 (the ceiling in the diagram) is constituted by a diaphragm 56. A piezoelectric element 58 which deforms the diaphragm 56 by applying pressure to the diaphragm 56 is bonded to the upper part of same, and an individual electrode 57 is formed on the upper surface of the piezoelectric element 58. Furthermore, the diaphragm 56 also serves as a common electrode.

The piezoelectric element 58 is sandwiched between the common electrode (which also serves as a diaphragm 56) and the individual electrode 57, and it deforms when a drive voltage is applied to these two electrodes 56 and 57. The diaphragm 56 is pressed by the deformation of the piezoelectric element 58, in such a manner that the volume of the pressure chamber 52 is reduced and ink is ejected from The nozzle 51. When the voltage applied between the two electrodes 56 and 57 is released, the piezoelectric element 58 returns to its original position, the volume of the pressure chamber 52 returns to its original size, and new ink is supplied into the pressure chamber 52 from the common supply channel 55 and via the supply port 53.

Figure 5:
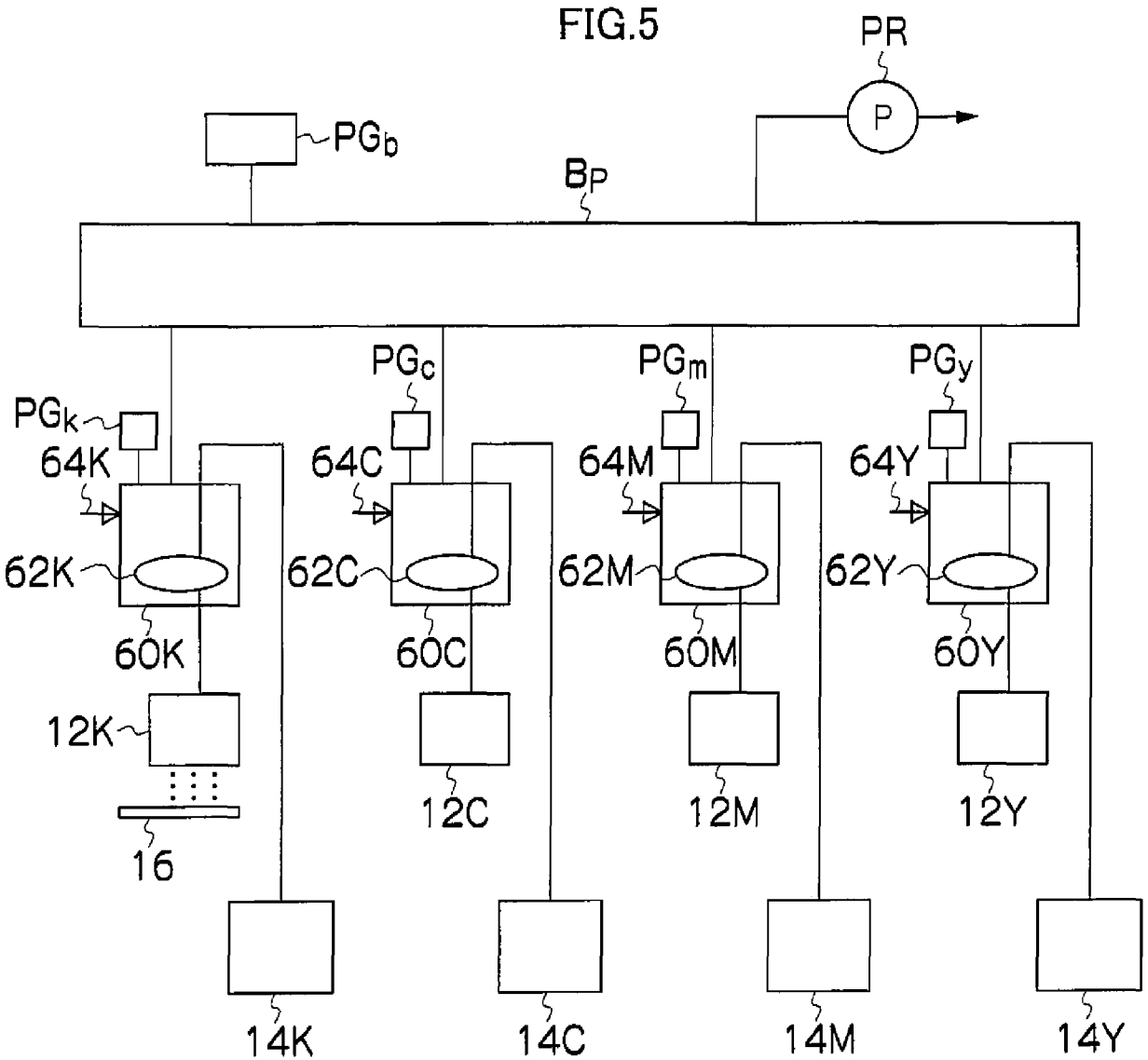
FIG. 5 is a general schematic drawing showing an ink supply system according to the first embodiment of the present invention.

FIG. 5 is a schematic drawing showing the configuration of the ink supply system in the inkjet recording apparatus 10.

As shown in FIG. 5, main tanks 14K, 14C, 14M and 14Y for supplying inks of respective colors are provided respectively for the print heads 12K, 12C, 12M and 12Y of the respective colors. The main tanks 14K, 14C, 14M, and 14Y are provided in the ink storing and loading unit 14 described with reference to FIG. 1. The aspects of the main tanks 14K, 14C, 14M, and 14Y include a refillable type and a cartridge type: when the remaining amount of ink is low, the ink tank of the refillable type is filled with ink through a filling port (not shown) and the ink tank of the cartridge type is replaced with a new one. In order to change the type of the ink to be used in accordance with the intended application, the cartridge type is suitable, and it is preferable to represent the ink type information with a bar code or the like on the cartridge, and to perform ejection control in accordance with the type of the ink. The main tanks 14K, 14C, 14M, and 14Y in FIG. 5 are equivalent to the ink storing and loading unit 14 in FIG. 1 described above.

Furthermore, as shown in FIG. 5, subsidiary tanks 60K, 60C, 60M and 60Y are provided respectively between the main tanks (14K, 14C, 14M, 14Y) and the print heads (12K, 12C, 12M, 12Y).

Each of the subsidiary tanks 60K, 60C, 60M and 60Y includes a corresponding one of ink bags 62K, 62C, 62M and 62Y provided therein. As shown in FIG. 5, the ink bags 62K, 62C, 62M and 62Y have a horizontally-expanded shape (in other words, each of the ink bags 62K, 62C, 62M and 62Y is arranged so as to extend in a horizontal direction). There are no particular restrictions on the ink bags 62K, 62C, 62M and 62Y, and it is possible to use an ink accommodating member that is flexible (for example, a bag formed by vapor deposition of aluminum onto resin is used as the material of the ink bag). The ink bags 62K, 62C, 62M and 62Y are preferably composed so as to be able to change in volume in accordance with the amount of ink accommodated therein. Inks of the respective colors corresponding to the main tanks 14K, 14C, 14M and 14Y are supplied respectively to the ink bags 62K, 62C, 62M and 62Y, and the inks of the respective colors are supplied respectively from the ink bags 62K, 62C, 62M and 62Y to the print heads 12K, 12C, 12M and 12Y.

In the present embodiment, the back pressures of the inks in the print heads 12K, 12C, 12M and 12Y are controlled by adjusting the pressures Ps of the air in the respective spaces inside the subsidiary tanks 60K, 60C, 60M and 60Y and outside the ink bags 62K, 62C, 62M and 62Y. In this case, since the ink bags 62K, 62C, 62M and 62Y have a horizontally-expanded shape, and since the change of the ink levels in the ink bags 62K, 62C, 62M and 62Y is negligible even when the consumed amounts of the ink in the ink bags 62K, 62C, 62M and 62Y are mutually different, then it is possible to control the back pressure independently for each of the print heads 12K, 12C, 12M and 12Y by adjusting the pressure Ps for each of the ink bags 62K, 62C, 62M and 62Y.

The space inside each of the subsidiary tanks 60K, 60C, 60M and 60Y is connected to a common pressure buffer Bp. The pressure Pb inside the pressure buffer Bp is controlled by a pressure reducing pump (negative pressure generating pump) PR which is common to all of the heads.

Furthermore, as shown in FIG. 5, the subsidiary tanks 60K, 60C, 60M and 60Y are also provided with differential pressure valves 64K, 64C, 64M and 64Y for adjusting the pressures Ps inside the respective subsidiary tanks, and pressure gages PGk, PGc, PGm, and PGy for measuring the respective pressures Ps inside the respective subsidiary tanks. Furthermore, the pressure buffer Bp is provided with a pressure gage PGb for measuring the pressure Pb inside the pressure buffer Bp.

In this way, the ink supply system shown in FIG. 5 includes a single (common) pressure buffer Bp that is connected with the subsidiary tanks 60K, 60C, 60M and 60Y provided so as to correspond to the individual heads 12K, 12C, 12M and 12Y, and the pressure inside the pressure buffer Bp is adjusted by means of a pressure reducing pump (negative pressure generating pump) PR, which is common for all of the heads 12K, 12C, 12M and 12Y. As described in more detail below, the individual subsidiary tanks 60K, 60C, 60M and 60Y are each connected to the exterior (the atmosphere) via the corresponding differential pressure valves 64K, 64C, 64M and 64Y, and can be kept at a constant pressure differential with respect to the atmospheric pressure by means of the action of the differential pressure valves 64K, 64C, 64M and 64Y. Therefore, the interior of the subsidiary tanks 60K, 60C, 60M and 60Y can be kept at a uniform pressure at all times.

Figure 6A:
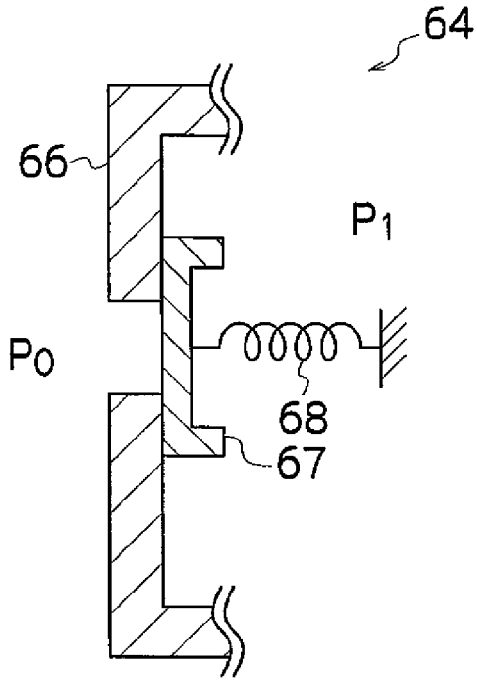
Figure 6B:
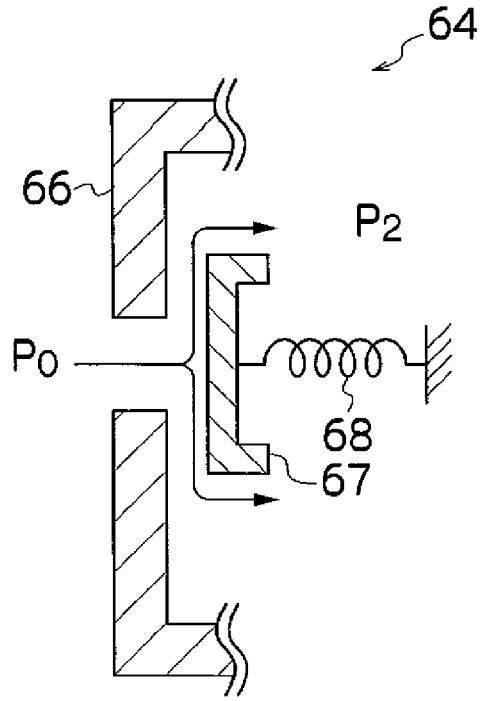

FIGS. 6A and 6B are diagrams showing the structure of the differential pressure valves 64 (64K, 64C, 64M, 64Y). The differential pressure valves 64K, 64C, 64M and 64Y all have the same structure, and are therefore referred to here simply as the "differential pressure valve(s) 64".

FIG. 6A shows a state where the differential pressure valve 64 is closed and FIG. 6B shows a state where the differential pressure valve 64 is open.

As shown in FIG. 6A, the differential pressure valve 64 is constituted of a frame body 66 and a valve body 67, and a spring 68 impelling the valve body 67 toward the frame body 66. In FIGS. 6A and 6B, the space to the right-hand side of the frame body 66 is the interior of the subsidiary tank, and the space to the left-hand side of the frame body 66 is the exterior of the subsidiary tank (i.e., the atmosphere). As shown in FIG. 6A, the external pressure $P_0$ is the atmospheric pressure, and the pressure inside the subsidiary tank is taken here to be $P_1$.

$P_1$ is a negative pressure and hence $P_1<P_0$, but since the valve body 67 is impelled against the frame body 66 by the spring 68, then as shown in FIG. 6A, the combined force of the pressure P1 inside the subsidiary tank and the force (pressure) of the spring 68 overcomes the atmospheric pressure $P_0$, and the valve body 67 is caused to make tight contact with the frame body 66, thereby closing the differential pressure valve 64.

However, if the pressure inside the subsidiary tank decreases from $P_1$ to $P_2$ ($P_2<P_1$) and the atmospheric pressure $P_0$ comes to be greater than the combined force of the pressure $P_2$ and the force (pressure) of the spring 68, then as shown in FIG. 6B, the valve body 67 is pushed by the atmospheric pressure $P_0$ and caused to separate from the frame body 66, and air flows into the subsidiary tank via the gap between the frame body 66 and the valve body 67, as indicated by the arrows in FIG. 6B. When the pressure inside the subsidiary tank has risen by a certain degree, then the valve body 67 is caused once again to make tight contact with the frame body 66, due to the force of the spring 68, and air stops flowing into the subsidiary tank.

In this way, the differential pressure valve 64 is normally closed as shown in FIG. 6A, and only opens as shown in FIG. 6B when the pressure differential between the pressure inside the subsidiary tank and the atmospheric pressure is greater than a prescribed pressure differential. In this way, in the present embodiment, since the differential pressure valve 64 uses the force of the spring 68, then a merit is obtained in that there is virtually no deterioration with time in the response of the differential pressure valve 64.

Figure 7A:
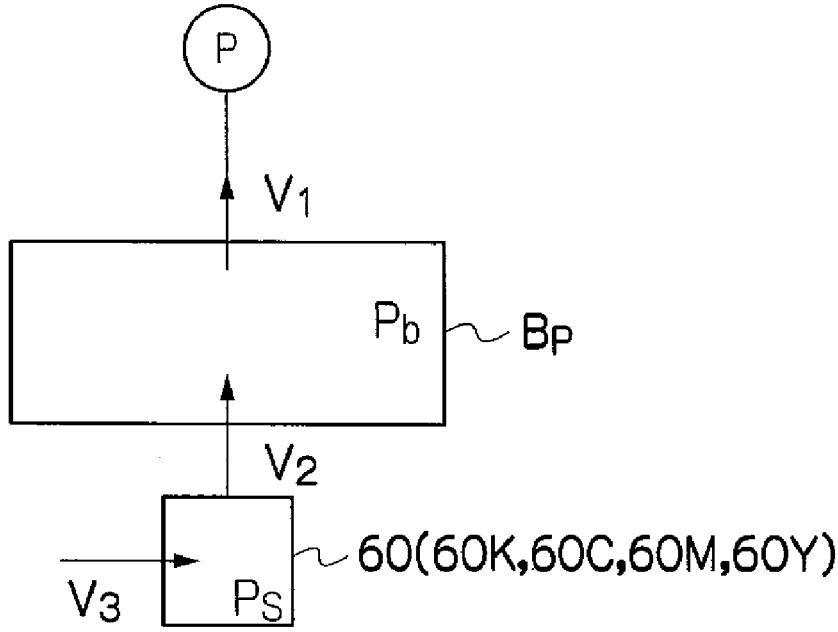
FIGS. 7A and 7B are illustrative diagrams showing the relationship between the pressure in a subsidiary tank and a pressure buffer.
Figure 7B:
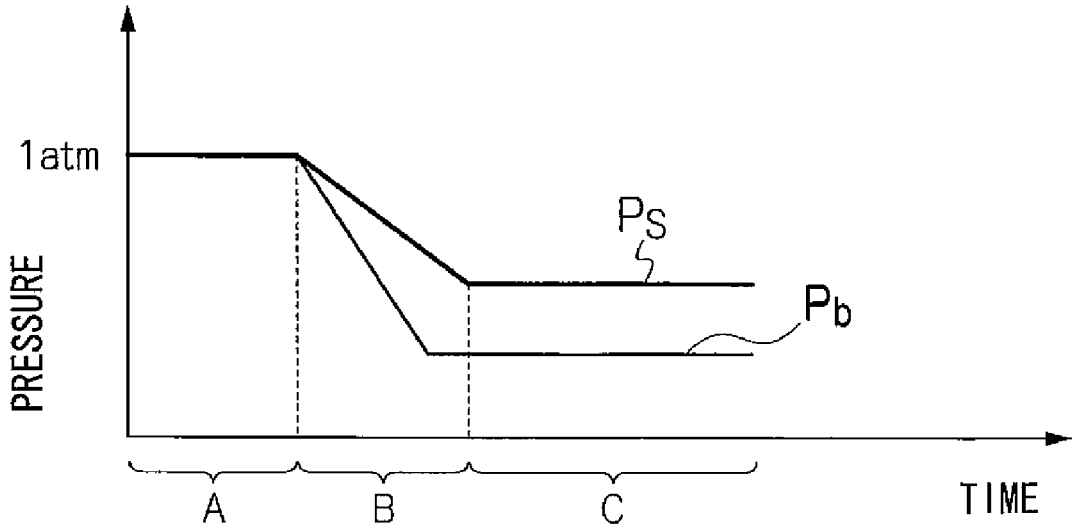

FIG. 7A is a diagram showing a schematic view of the subsidiary tank 60 and the pressure buffer Bp, and FIG. 7B is a diagram showing the change with time in the pressure Ps inside the subsidiary tank 60 and the pressure Pb inside the pressure buffer Bp.

As shown in FIG. 7A, the flow rate (volumetric flow) of air into the subsidiary tank 60 is taken to be $V_3$, the flow rate of air from the subsidiary tank 60 into the pressure buffer Bp is taken to be $V_2$, and the flow rate of air from the pressure buffer Bp into the pressure reducing pump is taken to be $V_1$. Also, the pressure in the subsidiary tank 60 is taken to be Ps, and the pressure in the pressure buffer Bp is taken to be Pb. FIG. 7A shows a schematic view of the subsidiary tank 60 and pressure buffer Bp, and only depicts one subsidiary tank 60, but if there are a plurality of subsidiary tanks 60K, 60C, 60M and 60Y, then the values of $V_2$ and $V_3$ are the sum totals of the corresponding flow rates for each subsidiary tank.

FIG. 7B shows the change over time in the pressures Ps and Pb. Firstly, in the steady state indicated by the symbol "A", the pressures are uniform (i.e., Ps=Pb=1 atm), and the flow rates have a relationship of $V_1=V_2=V_3=0$. Thereupon, when the pressure reducing pump is driven, the pressures Ps and Pb decrease gradually as indicated by the symbol "B". In this case, the pressures Ps and Pb have a relationship of Ps>Pb, and the flow rates $V_1$, $V_2$ and $V_3$ have a relationship of $V_3<V_2<V_1$. If the pressure reducing pump continues to be driven, then the system reaches the steady state indicated by the symbol "C". In this case, the pressures Ps and Pb have a relationship of Ps>Pb, and the flow rates $V_1$, $V_2$ and $V_3$ have a relationship of $V_3=V_2=V_1$. When this steady state is reached, the flow rate of the liquid exiting and entering the subsidiary tank is the same. Furthermore, the flow channel between the pressure buffer Bp and the subsidiary tank 60 (60K, 60C, 60M, 60Y) preferably has a large flow channel resistance, in order to maintain the pressure differential (i.e., to maintain a relationship of Ps−Pb>0). More specifically, the flow channel between the pressure buffer Bp and the subsidiary tank 60 preferably has a small diameter and a long length.

Below, the action of the present embodiment will be described.

The pressure reducing pump PR is driven in such a manner that the pressure Pb inside the pressure buffer Bp assumes a prescribed negative pressure. The pressure Pb is measured by the pressure gage PGb.

During printing, ink is ejected from the print heads 12K, 12C, 12M and 12Y, toward the recording paper 16. The volume of the ink bags 62K, 62C, 62M and 62Y inside the subsidiary tanks 60K, 60C, 60M and 60Y changes in accordance with the amount of ink consumed, and the pressure Ps inside each of the subsidiary tanks 60K, 60C, 60M and 60Y changes, accordingly.

In this case, by adjusting the force of the spring 68 (see FIGS. 6A and 6B) in each of the differential pressure valves 64K, 64C, 64M, 64Y in advance, it is possible to set the pressure Ps inside each of the subsidiary tanks 60K, 60C, 60M and 60Y to a uniform value, due to the action of the differential pressure valves 64K, 64C, 64M and 64Y. Therefore, it is possible to control the back pressures of the print heads 12K, 12C, 12M and 12Y, to a uniform pressure.

In the present embodiment, since there is no valve between the pressure reducing pump PR and the pressure buffer Bp, then the pressure reducing pump PR is required to be driven continuously, even if ejection is not being performed from the print heads 12K, 12C, 12M and 12Y.

Although the pressure reducing pump PR is required to be driven continuously as described above, the following two countermeasures are possible.

Figure 8:
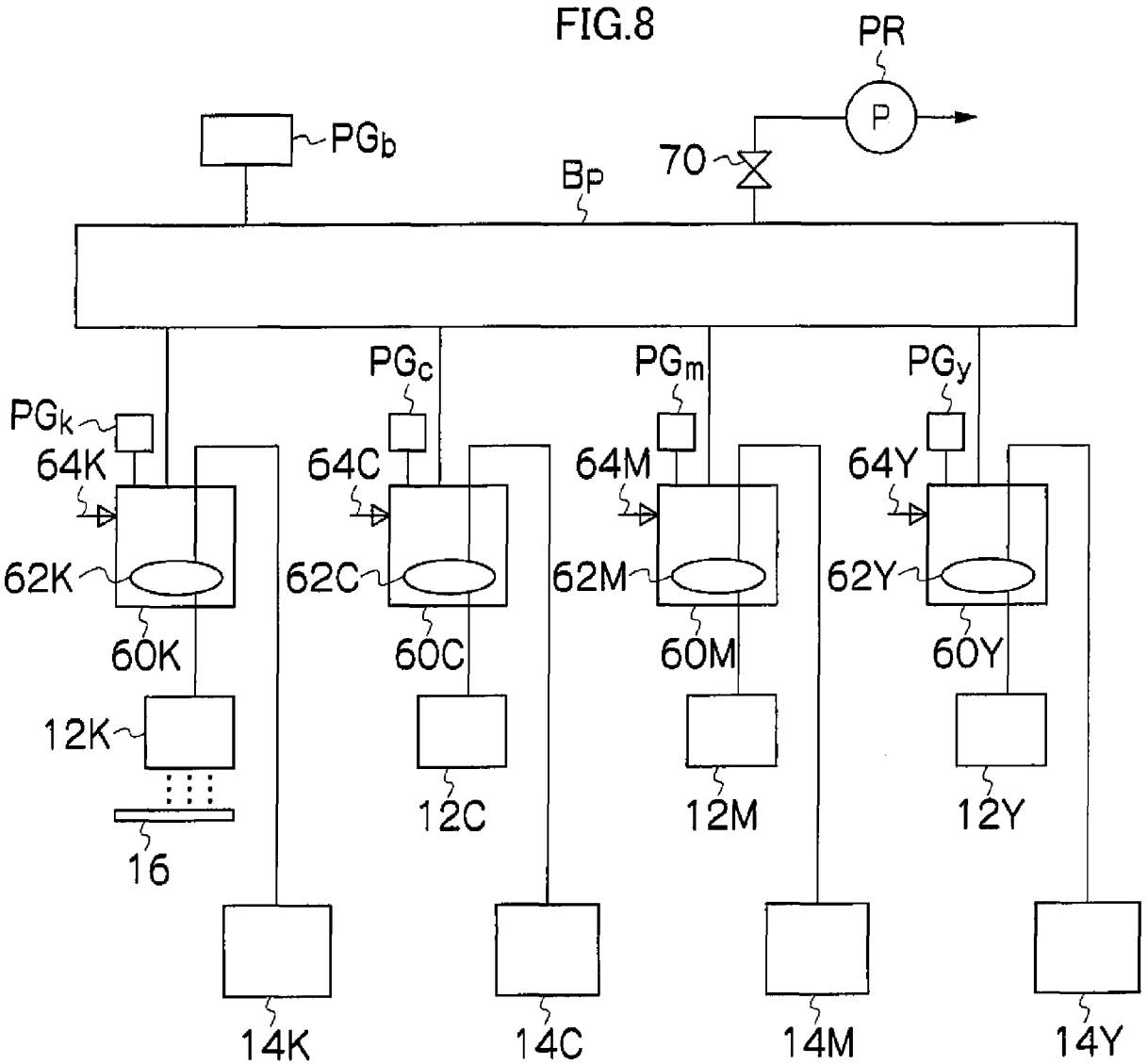
FIG. 8 is a general schematic drawing showing another example of an ink supply system according to the first embodiment of the present invention.

As shown in FIG. 8, one countermeasure is to add a valve 70 arranged between the pressure reducing pump PR and the pressure buffer Bp, with respect to the ink supply system according to the first embodiment, which is shown in FIG. 5.

In the ink supply system shown in FIG. 8, when controlling the back pressure in each of the print heads 12K, 12C, 12M and 12Y, the target pressure P (i.e., a pressure below which air flows into the subsidiary tank 60 through the differential pressure valve 64, and above which air stops flowing into the subsidiary tank 60) of the pressure Ps inside each of the subsidiary tanks 60K, 60C, 60M and 60Y is set to be greater than the pressure Pb inside the pressure buffer Bp, namely, P>Pb. In this case, the target pressure P can be changed by adjusting the force of the spring 68 of the differential pressure valve 64.

Furthermore, if none of the print heads 12K, 12C, 12M and 12Y is performing ink ejection, and hence there is no consumption of ink, then the valve 70 between the pressure buffer Bp and the pressure reducing pump PR is closed. The air continues to flow into any of the subsidiary tanks 60K, 60C, 60M and 60Y through the corresponding differential pressure valve 64 for a while even after the valve 70 is closed, since a condition of Pb<Ps<P is still satisfied. But the inflow of air ultimately halts when Pb and Ps become equal to P (i.e., Pb=Ps=P), and the pressure Pb inside the pressure buffer Bp and the pressure Ps inside the subsidiary tanks 60K, 60C, 60M and 60Y are kept at a uniform pressure. In the above-described configuration, the pressure reducing pump PR is not required to maintain airtight conditions when it is halted.

Furthermore, a further countermeasure is to adjust the flow rate of the pressure reducing pump PR, rather than providing a valve as in the example shown in FIG. 8.

In this case, when controlling the back pressure, the target pressure P (i.e., a pressure below which air flows into the subsidiary tank 60 through the differential pressure valve 64, and above which air stops to flow into the subsidiary tank 60) inside the subsidiary tanks 60K, 60C, 60M and 60Y is set to be greater than the pressure Pb inside the pressure buffer Bp, namely, P>Pb.

Furthermore, if none of the print heads 12K, 12C, 12M and 12Y performs ejection and hence there is no consumption of ink, then the pressure reducing pump PR is halted. The air flows into any of the subsidiary tanks 60 through the corresponding differential pressure valves 64 (64K, 64C, 64M, 64Y) for a while even after the pressure reducing pump PR is halted, since a condition of Pb<Ps<P is still satisfied. But the inflow of air ultimately halts when Pb and Ps become equal to P (i.e., Pb−Ps=P), and the pressure Pb inside the pressure buffer Bp the pressure Ps inside the subsidiary tanks 60K, 60C, 60M and 60Y are kept at a uniform pressure. Furthermore, in this case, the pressure reducing pump PR is required to maintain airtight conditions when it is halted. The cost of this composition is lower than that of the composition shown in FIG. 8, since it does not include the valve 70.

In these two countermeasures, since the internal pressure of the subsidiary tanks 60K, 60C, 60M and 60Y and the internal pressure of the pressure buffer Bp are the same when the head is not operating, then if there is a sudden change in the back pressure, it is difficult to follow this change. Therefore, it is desirable that the pressure change caused by ejection of ink should be predicted in advance on the basis of the print data, and that the operation of the pressure reducing pump should be started before the ink is started to be ejected form the head. By this means, stable image quality can be achieved.

Next, a second embodiment of the present invention will be described.

Figure 9:
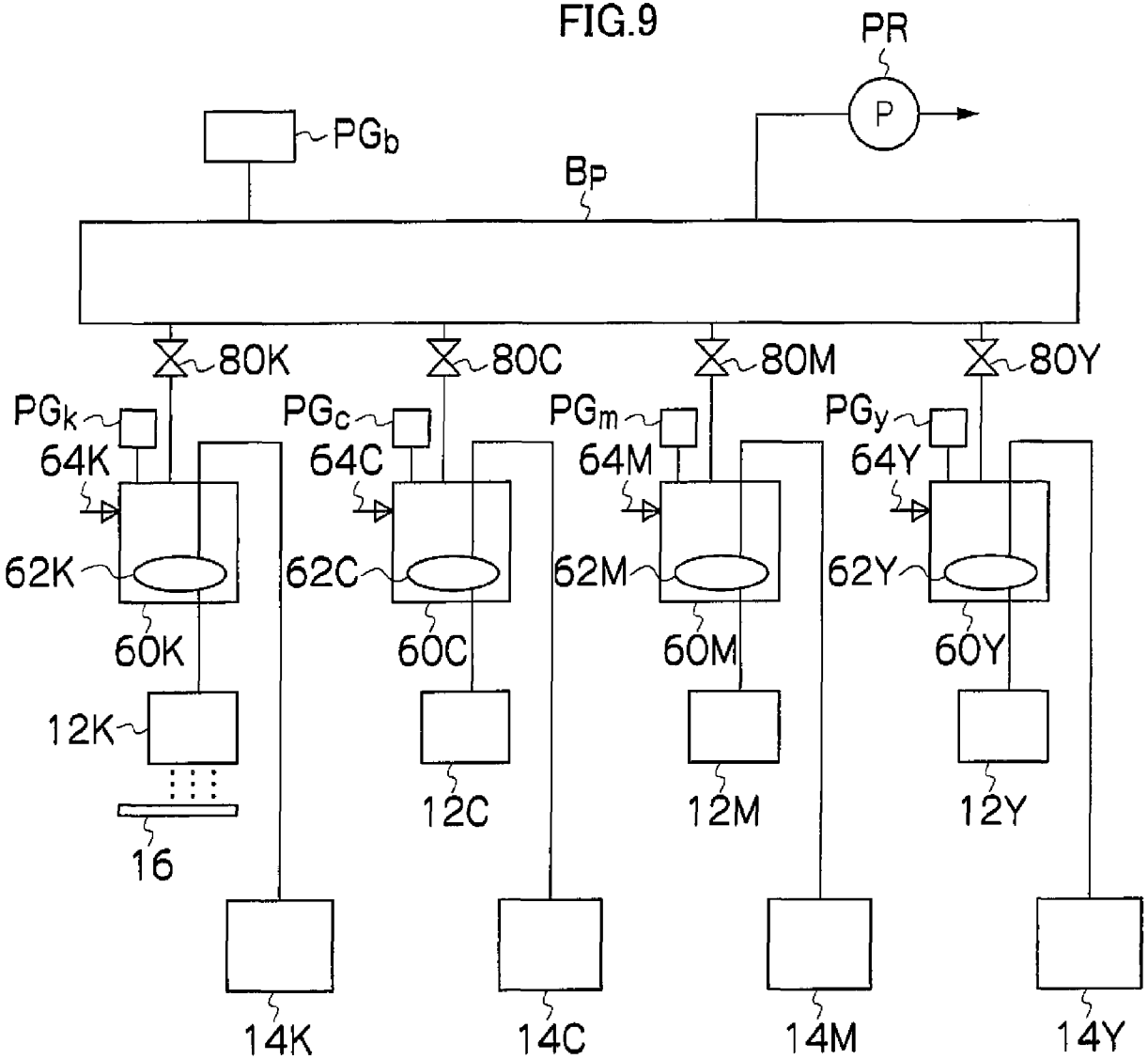
FIG. 9 is a general schematic drawing showing an ink supply system according to a second embodiment of the present invention.

FIG. 9 is a diagram showing an overview of the composition of the ink supply system according to the second embodiment.

As shown in FIG. 9, in the second embodiment, valves 80K, 80C, 80M and 80Y are added, which are arranged between the pressure buffer Bp and the subsidiary tanks 60K, 60C, 60M and 60Y, with respect to the ink supply system according to the first embodiment described above, which is shown in FIG. 5.

The merit obtained with respect to the first embodiment shown in FIG. 5 by disposing the valves 80K 80C, 80M and 80Y respectively between the pressure buffer Bp and the subsidiary tanks 60K, 60C, 60M and 60Y is as follows. If the internal pressure Pb of the pressure buffer Bp is lower than the internal pressure Ps of the subsidiary tank (Pb<Ps) when all of the valves 80K, 80C, 80M and 80Y are closed, it is possible to expect a function whereby the pressure buffer Bp can be maintained at a uniform pressure the next time that (any one of) the valves 80K, 80C, 80M and 80Y is opened, and therefore the pressure reducing pump PR is not required to be operated at all time.

It is enough to resume the operation of the pressure reducing pump PR when any one of the valves 80K, 80C, 80M and 80Y is opened, but it is desirable that the operation of the pressure reducing pump PR be resumed at the time that consumption of the ink is predicted on the basis of the print data, since even if sudden consumption of ink occurs, it is still possible to achieve stable ejection without there being any reduction in the pressure of the pressure buffer Bp. For example, it is possible to prevent the occurrence of problems where the negative pressure becomes larger, ink refilling (ink supply) to the pressure chambers becomes unable to keep up with demand, and the size of the ejected droplets consequently becomes smaller.

Further, it is also possible to make the pressure buffer Bp small in size, and therefore compactification of the apparatus and cost reduction can be achieved.

Below, the action according to the present embodiment is described with reference to the flowchart in FIG. 10.

Figure 10:
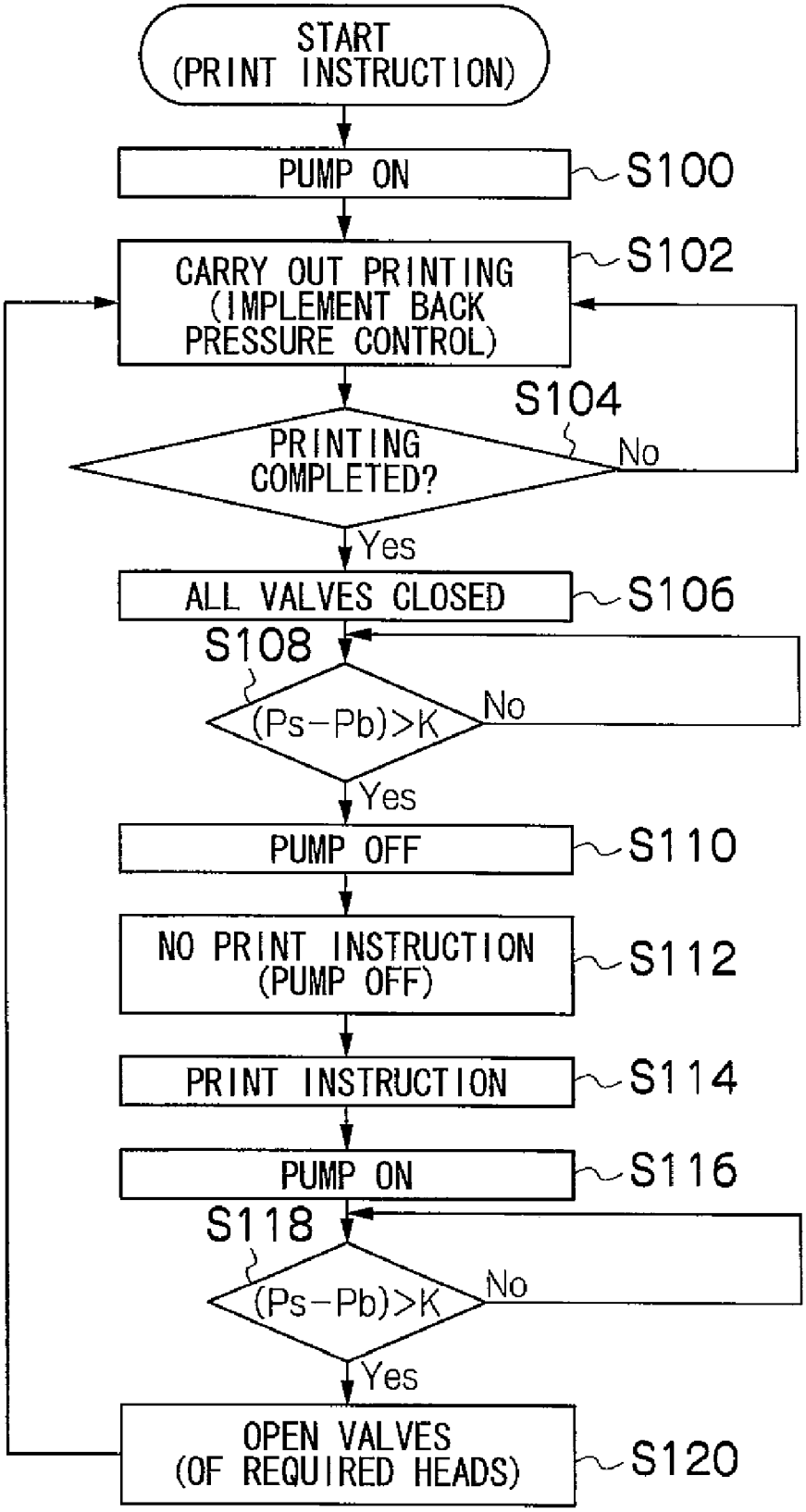
FIG. 10 is a flowchart showing an ink supply method according to the second embodiment.
Figure 11A:
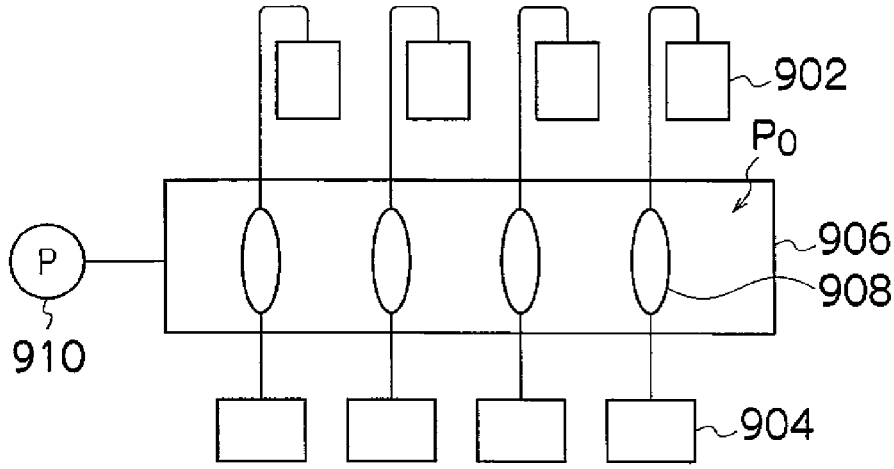
FIG.11A RELATED ART
FIGS. 11A to 11C are illustrative diagrams showing an ink supply system in the related art.
Figure 11B:
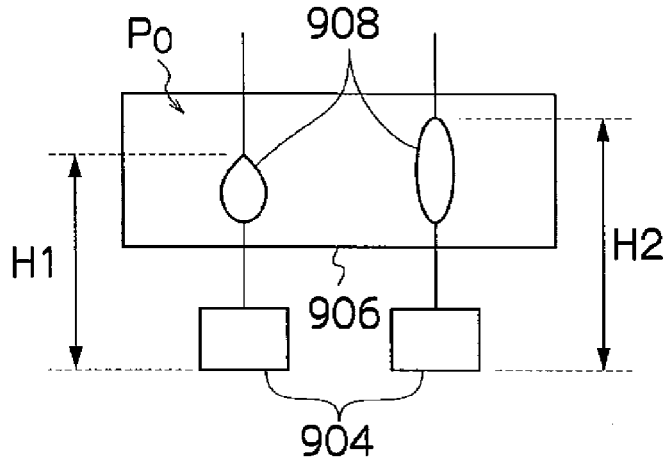
FIG.11B RELATED ART
Figure 11C:
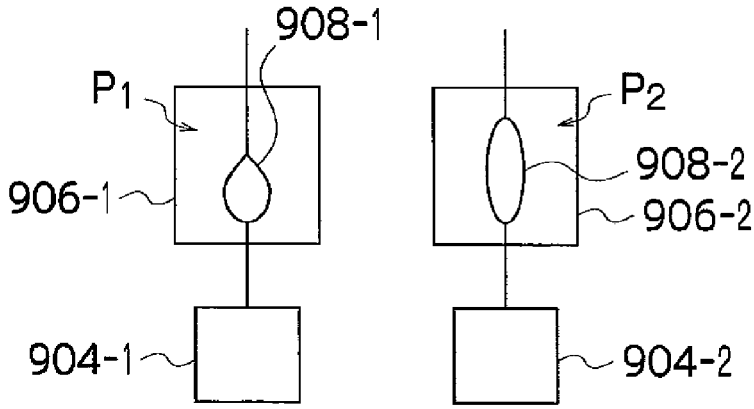
FIG.11C RELATED ART
Figure 12A:
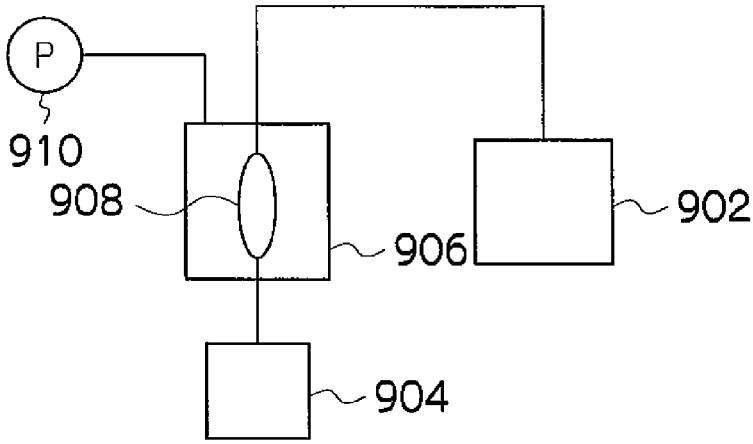
FIG.12A RELATED ART
FIGS. 12A and 12B are illustrative diagrams showing another example of the ink supply system in the related art.
Figure 12B:
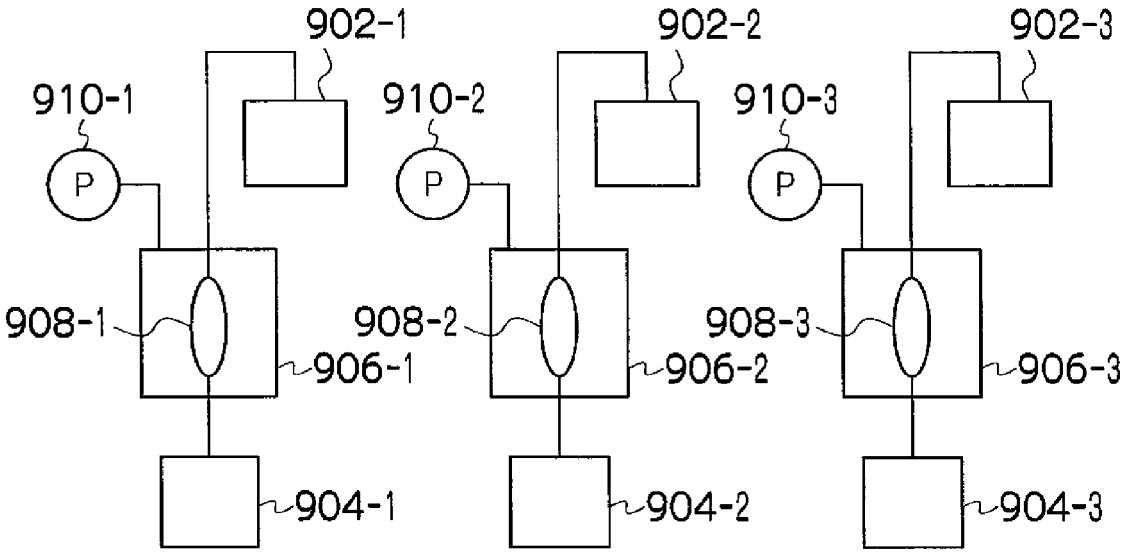
FIG.12B RELATED ART

Firstly, in step S100 in FIG. 10, if there is a print instruction, then the driving of the pressure reducing pump PR is started (pump ON). Next, in step S102, printing is carried out. In this step, the back pressure of the print heads 12K, 12C, 12M and 12Y is controlled by the action of the differential pressure valves 64 (64K, 64C, 64M and 64Y) of the respective subsidiary tanks 60K, 60C, 60M and 60Y.

Thereupon, at step S104, it is judged whether or not printing has terminated (whether there is any print data to be printed), and if there is still print data, then the procedure returns to step S102 and printing is carried out, whereas if there is no print data, then printing is terminated and the procedure advances to step S106.

At step S106, all of the valves 80K 80C, 80M and 80Y attached to the subsidiary tanks 60K, 60C, 60M and 60Y are closed.

Thereupon, at step S108, the internal pressures of the respective subsidiary tanks 60K, 60C, 60M and 60Y are measured by the pressure gages PGk, PGc, PGm and PGy provided in the respective subsidiary tanks 60K, 60C, 60M and 60Y, and it is judged whether or not the pressure differential Ps−Pb between the total value Ps of the internal pressures of the respective subsidiary tanks 60K, 60C, 60M and 60Y and the internal pressure Pb of the pressure buffer Bp has exceeded a prescribed threshold value K.

If the pressure differential Ps−Pb has not exceeded the prescribed threshold value K, then step S108 is repeated while the driving of the pressure reducing pump PR is continued until the pressure differential does exceed the threshold value.

If the pressure differential Ps−Pb has exceeded the prescribed threshold value K, then at step S110, the driving of the pressure reducing pump PR is halted (pump OFF), and at step S112, if there is no print instruction, then the pressure reducing pump PR is kept in a halted state.

Thereupon, at step S114, if a print instruction has been issued, then at the next step, S116, the driving of the pressure reducing pump PR is resumed (pump ON). In this case, all of the valves 80K, 80C, 80M and 80Y are kept closed.

Thereupon, at step S118, similarly to step S108 described above, it is judged whether or not the pressure differential Ps−Pb has exceeded a prescribed threshold value K, and step S118 is repeated until the pressure differential Ps−Pb exceeds the prescribed threshold value K.

At step S120, valves of the valves 80K, 80C, 80M and 80Y of the subsidiary tanks 60K, 60C, 60M and 60Y corresponding to the print heads 12K, 12C, 12M and 12Y, that are required on the basis of the print data are opened, the procedure returns to step S102, and printing is carried out.

In this way, the respective subsidiary tanks 60K, 60C, 60M and 60Y are connected to the pressure reducing pump PR via the pressure buffer Bp, and are also configured to have differential pressure valves 64 (64K, 64C, 64M and 64Y) which are connected to the atmosphere, and therefore it is possible to control the internal pressures of the respective subsidiary tanks 60K, 60C, 60M and 60Y independently, while using the common pump (pressure reducing pump PR) for the plurality of print heads 12K, 12C, 12M and 12Y.

Furthermore, since the pressure reducing pump PR is halted when not carrying out printing, and the driving of the pressure reducing pump PR is resumed before printing is started, then it is possible to maintain the necessary back pressure in the heads, even in the case of a restart of printing which involves sudden consumption of ink.

The inkjet recording apparatus and ink supply method according to the present invention has been described in detail above, but the present invention is not limited to the aforementioned examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

print heads each of which has ejection ports through which ink is ejected;

main tanks each of which stores the ink;

ink supply channels which respectively connect the main tanks with the print heads;

subsidiary tanks which are arranged in the ink supply channels and each of which includes an external case and an ink accommodating member that is flexible and arranged in the external case, the ink being supplied from the main tanks to the print heads through the ink supply channels and the ink accommodating members in the subsidiary tanks;

a pressure buffer which is connected to spaces in the subsidiary tanks between the external cases and the ink accommodating members;

a common pressure reducing pump which reduces a pressure Pb inside the pressure buffer and is shared by the subsidiary tanks;

differential pressure valves which are respectively attached to the subsidiary tanks so as to connect the spaces in the subsidiary tanks with an atmosphere such that each of pressures Ps inside the spaces in the subsidiary tanks is set to a uniform pressure;

a first pressure gage which measures the pressure Pb inside the pressure buffer; and a second pressure gage which measures the pressures Ps inside the spaces in the subsidiary tanks, wherein an operation of the common pressure reducing pump to reduce the pressure Pb inside the pressure buffer is performed and the differential pressure valves adjust the pressures Ps inside the spaces in the subsidiary tanks so that each of the pressures Ps inside the spaces in the subsidiary tanks is set to the uniform pressure, the pressure Pb inside the pressure buffer and each of the pressures Ps inside the spaces in the subsidiary tanks have a relationship of Pb<Ps, and each of back pressures of the print heads is thereby set to a uniform back pressure, at least while the ink is being ejected from the print heads.

2. The inkjet recording apparatus as defined in claim 1, wherein the operation of the common pressure reducing pump is halted, while the ink is not being ejected from the print heads.

3. The inkjet recording apparatus as defined in claim 2, wherein the operation of the common pressure reducing pump is resumed before the ink is started to be ejected from the print heads, when printing is restarted from a state where the ink is not being ejected from the print heads and the operation of the common pressure reducing pump is halted.

4. The inkjet recording apparatus as defined in claim 1, further comprising a valve arranged between the pressure buffer and the common pressure reducing pump, wherein the valve is closed and the operation of the common pressure reducing pump is halted, while the ink is not being ejected from the print heads.

5. The inkjet recording apparatus as defined in claim 1, further comprising valves which are arranged between the pressure buffer and the subsidiary tanks, respectively, wherein the valves are closed and the operation of the common pressure reducing pump is halted, while the ink is not being ejected from the print heads.

6. A method of supplying ink from main tanks to print heads for an inkjet recording apparatus which includes: the print heads each of which has ejection ports through which the ink is ejected; the main tanks each of which stores the ink; subsidiary tanks which are respectively arranged between the main tanks and the print heads and each of which includes an external case and an ink accommodating member that is flexible and arranged in the external case, the ink being supplied from the main tanks to the print heads through the ink accommodating members in the subsidiary tanks; a pressure buffer which is connected to spaces in the subsidiary tanks between the external cases and the ink accommodating members; a common pressure reducing pump which reduces a pressure inside the pressure buffer and is shared by the subsidiary tanks: and differential pressure valves which are respectively attached to the subsidiary tanks and connect the spaces in the subsidiary tanks with an atmosphere such that each of pressures Ps inside the spaces in the subsidiary tanks is set to a uniform pressure, the method comprising the steps of:

measuring the pressures Ps inside the spaces in the subsidiary tanks between the external cases and the ink accommodating members;

measuring a pressure Pb inside the pressure buffer; and reducing the pressure Pb inside the pressure buffer by means of the common pressure reducing pump and adjusting the pressures Ps by means of the differential pressure valves so that each of the pressures Ps inside the spaces in the subsidiary tanks is set to the uniform pressure, the pressure Pb and each of the pressures Ps have a relationship of Pb<Ps, and thereby setting each of back pressures of the print heads to a uniform back pressure, at least while the ink is being ejected from the print heads.

* * * * *